US005666612A

United States Patent [19]

Beachner et al.

[11] Patent Number: 5,666,612

[45] Date of Patent: Sep. 9, 1997

[54] ROLLER TO PRESS THE IMAGE TONER ON THE PHOTORECEPTOR

[75] Inventors: James R. Beachner, Webster; Henry R. Till, East Rochester, both of N.Y.

[73] Assignee: Xerox Corporation, Stamford, Conn.

[21] Appl. No.: 699,290

[22] Filed: Aug. 19, 1996

[51] Int. Cl.[6] ..... G03G 15/01

[52] U.S. Cl. ..... 399/223; 399/231; 430/45

[58] Field of Search ..... 430/42, 45, 47; 399/223, 231, 296, 264

[56] References Cited

U.S. PATENT DOCUMENTS

| | | | |
|---|---|---|---|
| 4,660,059 | 4/1987 | O'Brien | 346/157 |
| 4,833,503 | 5/1989 | Snelling | 355/259 |
| 5,208,636 | 5/1993 | Rees et al. | 355/219 |
| 5,241,356 | 8/1993 | Bray et al. | 355/328 |
| 5,258,820 | 11/1993 | Tabb | 355/328 |
| 5,282,006 | 1/1994 | Fletcher | 355/273 |
| 5,539,506 | 7/1996 | Bean et al. | 399/270 |
| 5,600,430 | 2/1997 | Folkins et al. | 399/171 |

FOREIGN PATENT DOCUMENTS 3-202869 9/1994 Japan .

*Primary Examiner*—Joan H. Pendegrass

[57] ABSTRACT

A multi-color imaging apparatus utilizing recharging between two image creation steps for recharging a charge retentive surface to a predetermined potential prior to forming a second of the two images. The two images are formed using toner particles which are subject to under color splatter (UCS). The UCS phenomena occurs when a developed image passes through a toner cloud created by a certain type of scavengeless development system. The forgoing problem is obviated by applying pressure to toner images in combination with recharging thereof prior to their passage through a developer housing.

20 Claims, 3 Drawing Sheets

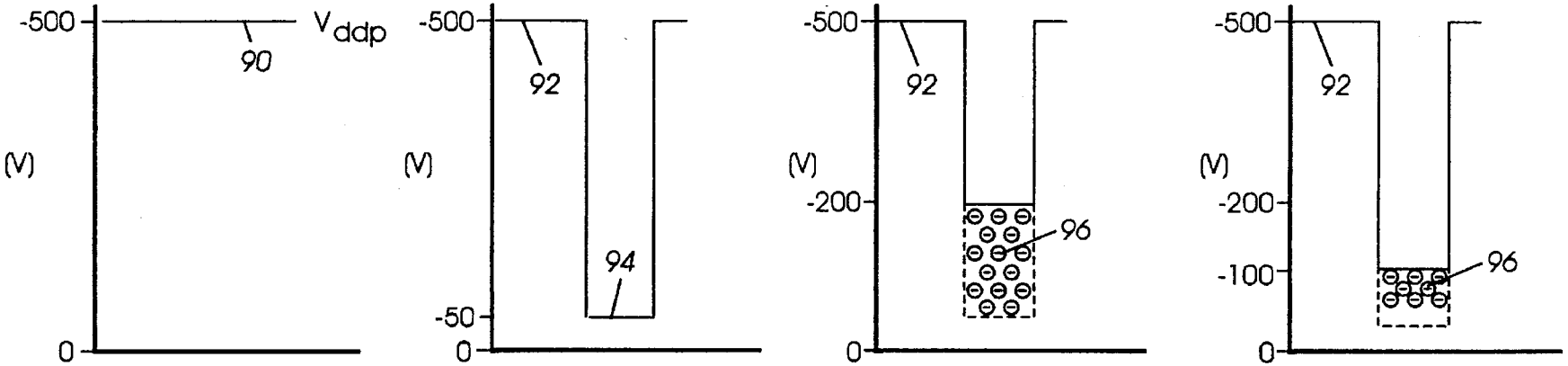
FIG. 1A
FIG. 1B
FIG. 1C
FIG. 1D
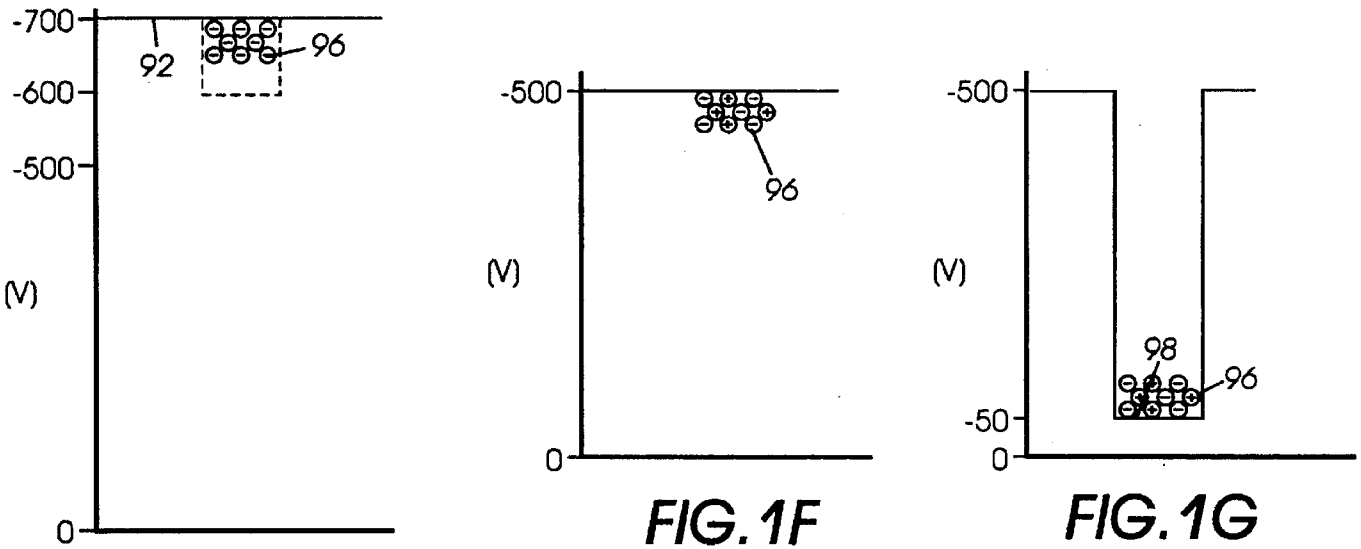
FIG. 1E
FIG. 1F
FIG. 1G

ROLLER TO PRESS THE IMAGE TONER ON THE PHOTORECEPTOR

BACKGROUND OF THE INVENTION

This invention relates generally to electrostatic imaging and more particularly to the conditioning of powder images for rendering them insensitive to development systems through which they are transported.

In the process of electrostatic imaging such as plain paper xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member.

With the advent of processors capable of creating multiple images using corona emissions, toner image disturbance of an already developed powder image passing through one or more developer housings had to be address. Early attempts at obviating such image disturbances led to the use of scavengeless developer systems. One such system utilizes biased electrodes to form toner clouding in the development zone intermediate the imaging or charge retentive surface and a developer housing. In an Image On Image (IOI) xerographic system using scavengeless development, the forgoing problem of image disturbance is dealt with using a split charging system such as disclosed in U.S. patent application Ser. No. 08/347,617 filed on Nov. 30, 1994 in the name of Folkins et al. The purpose of using a split recharge system as disclosed in the aforementioned application is to insure that developed and non-developed image areas of a charged retentive surface are at or near the same electrical potential when passing through a developer housing. However, such development systems tend to damage images through a phenomena know as Under Color Splatter (UCS). UCS is caused when a neutralized or wrong sign toner layer passes through toner clouds of a scavengeless developer housing through which it passes. The toner cloud knocks loosely held toner particles off developed images causing a halo on the trail edge of the new image.

The Recharge/Expose/and Develop (REaD) imaging process as disclosed in the aforementioned patent application is repeated for each subsequently developed image in superimposed registration on the charge retentive surface until a complete image, in the case of the '617 patent application, a full color image is created. The different colors may be developed on the photoreceptor in an image on image development process, or a highlight color image development process (image next-to image). As may be appreciated, the REaD profess is not restricted to color imaging. For example, it may also be used in a process where only black images are created with clear toner being used for forming glossy images.

The images may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass). As will be appreciated, various other combinations are possible.

Several issues arise that are unique to the REaD IOI process of creating multi-color images in the attempt to provide optimum conditions for the development of subsequent color images onto previously developed color images. For example, during a recharge step, it is important to level the voltages among previously toned and untoned areas of the photoreceptor so that subsequent exposure and development steps are effected across a uniformly charged surface. The greater the difference in voltage between those image areas of the photoreceptor previously subjected to a development and recharge step; those image areas subjected to a development step, but not yet subjected to a recharge step; and those bare non-developed, untoned areas of the charge retentive surface, the larger will be the difference in the development potential between these areas for the subsequent development of image layers thereon.

Another issue that must be addressed with the REaD IOI color image formation process is the residual charge and the resultant voltage drop that exists across the toner layer of a previously developed area of the photoreceptor. Although it may be possible to achieve voltage uniformity by recharging this previously toned layer to the same voltage level as neighboring bare areas, the associated residual toner voltage ($V_r$) prevents the effective voltage above any previously developed toned areas from being re-exposed and discharged to the same level as neighboring bare photoreceptor areas which have been exposed and discharged to the actual desired voltage levels. Furthermore, the residual voltage associated with previously developed toner images reduces the dielectric and effective development field in the toned areas, thereby hindering the attempt to achieve a desired uniform consistency of the developed mass of subsequent toner images. The problems become increasingly severe as additional color images are subsequently exposed and developed thereon. Color quality is severely compromised by the presence of the toner charge and the resultant voltage drop across the toner layer. The change in voltage due to the toned image can be responsible for color shifts, increased moire, increased color shift sensitivity to image misregistration and motion quality, toner spreading at image edges, and loss in latitude affecting many of the photoreceptor subsystems. Thus, it is ideal to reduce or eliminate the residual toner voltage of any previously developed toned images.

Prior attempts to address one or more of these issues have introduced a variety of secondary problems, each having an adverse effect on the image on image color image formation process. For example, the concurrently filed, copending application for patent entitled "Method and Apparatus for Reducing Residual Toner Voltage", Ser. No. 08/347,616, by a common assignee as the present application, discloses a voltage sensitive recharge device used for the recharging steps during a color image formation, whose graph of the output current (I) to the charge retentive surface as a function of the voltage to the charge retentive surface (V) has a high (I/V) slope. The high I/V slope recharge device disclosed having an AC voltage supplied thereto, enables an extended time for neutralization to occur at the top of the toner layers. However, the amount of residual voltage $V_r$ reduction that can be realized is somewhat limited.

Another recharging method is described in application for Japanese Patent No. Hei 1-340663, Application date Dec. 29, 1989, Publication date Sep. 4, 1991, assigned to Matsushita Denki Sangyo K.K. This reference discloses a color image forming apparatus wherein a first and second charging device are used to recharge a photoconductor carrying a first developed image, before exposure and development of a subsequent image thereon. The potential of the photoconductor is higher after passing the first charging device than after passing the second charging device. This reference teaches that the difference in voltage applied by the first and second charging devices to the toner image and photoreceptor surface is set to a relatively high level, to insure that the polarity of the toner image is reversed after passing and having been charged by both devices. The effect of this teaching is to reduce the residual charge in the image areas which becomes more severe when applying color toners onto previously developed color toners, and also to prevent toner spray (or toner spread) during the exposure process. Toner spray is a phenomena caused when the photoconductor carrying the first toner image is recharged to a relatively high charge level and then exposed for the second image development. In areas where the edges of a prior developed image align but do not overlap with the edges of a subsequent image, the toner of the prior image tends to spray or spread along its edges into the subsequently exposed areas which have a relatively lower charge level. By reversing the polarity of the toner as taught in this reference, toner spray is prevented, as the reversed polarity toner is no longer attracted to the exposed areas.

However, when a substantial amount of toner charge at the top of a previously developed toner layer is reversed in polarity during recharge, a different problem of a serious nature develops. Since the prior toner image is now predominantly of an opposite polarity to both the bare background areas and the incoming color toner to be developed thereon, an interaction occurs among these three separate and distinctly charged regions. For example, in a system having a negatively charged photoreceptor using Discharged Area Development (DAD), the negatively charged toner used for development would be reversed in polarity after recharge using the teachings of Matsushita. Particularly, the now-positively charged toner layer is then attracted to the negatively charged background areas and the negatively charged toner of the incoming color image. Thus, the positively charged toner of the first image tends to splatter into neighboring bare background regions. This occurrence has been titled the Under Color Splatter (UCS) defect and is the cause of unwanted blending of colors and the spreading of colors from image edges into background areas. The UCS defect is apparent both where the prior image aligns with a subsequent image, and also where the prior image overlaps with the subsequent image. Consequently, color clarity is severely impacted. Furthermore, when a relatively large voltage difference between the first and second charging devices is applied to the photoreceptor surface in order to reverse the polarity of the toner image, a significant amount of stress is applied to the photoreceptor, which may also negatively impact image quality, as well as reduce the life expectancy of the photoreceptor.

Notwithstanding the efforts that have been made as described above, UCS in scavengeless development systems has persisted.

Following is a discussion of prior art, incorporated herein by reference, which may bear on the patentability of the present invention. In addition to possibly having some relevance to the question of patentability, these references, together with the detailed description to follow, should provide a better understanding and appreciation of the present invention.

U.S. Pat. No. 5,282,006 relates to an apparatus for transferring a developed toner image from an image bearing surface to a final support substrate including a corona generating device for establishing a transfer field and a pressure treatment apparatus for compacting the toner image on the image bearing surface. The pressure treatment apparatus substantially prevents premature transfer of toner across air gaps between the image bearing surface and the final support substrate.

U.S. Pat. No. 4,833,503 discloses a multi-color printer wherein a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image by a corona generating unit and an erase lamp.

U.S. Pat. No. 5,208,636, discloses a printing system wherein charged area images and discharged area images are created, the former being formed first and the latter being proceeded by a recharging of the imaging surface.

U.S. Pat No. 5,241,356 discloses a multi-color printer wherein charged area images and discharged area images are created, the former being formed first, followed by an erase step and a recharge step before the latter is formed. An erase lamp is used during the erase step to reduce voltage non-uniformity between toned and untoned areas on a charge retentive surface.

U.S. Pat. No. 5,258,820 discloses a multi-color printer wherein charged area images and discharged area images are created. An erase lamp is used following development using Charged Area Development (CAD), and a pre-recharge corona device is used following development using Discharged Area Development (DAD) and prior to a recharge step, to reduce voltage non-uniformity between toned and untoned images on a charge retentive surface.

Application for U.S. patent titled "Method and Apparatus for Reducing Transferred Background Toner", Ser. No. 08/346,708 by a common assignee as the present application, discloses a corona recharge device for recharging the photoreceptor containing at least one previously developed color image, to a voltage level intermediate to the background areas and the image areas. This intermediate recharge level keeps wrong-charge toner developed in the background areas at a charge level distinct from the toner developed in the image areas, so that the wrong-charge background toner does not transfer to a support substrate with the image.

A number of commercial printers employ the REaD imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

BRIEF SUMMARY OF THE INVENTION

In accordance with the invention, there is provided, in a multiple image creation process and apparatus, structure for minimizing the disturbance of developed images as they move through a scavengeless development housing. To this end, pairs of pressure engaged rolls are positioned in the imaging process path for compressing or compacting toner images prior to their movement through one or more scavengeless developer housings. One roller of each pair of pressure-engaged rollers is positioned for contact with the imaged side of the charge retentive surface while the other roller of each pair contacts the opposite side of the charge retentive surface such that the charge retentive surface moves through a nip formed therebetween. The roller of each pair contacting the powder images is electrically biased. The bias voltage is such that toner particles forming the image are prevented from being transferred to the biased roller. The electrical bias also serves to remove wrong sign toner from the charge retentive surface.

In order for the electrically biased rollers to perform the stated function, it is necessary to guarantee that the developed images comprise unipolar toner. To this end, a number of REaD process devices are used for treating the developed image areas on a charge retentive surface so that a unipolar image is presented to each roller pair. The REaD process devices are also serve to minimize the difference in electrical potential between imaged and non-image areas of the charge retentive surface.

BRIEF DESCRIPTION OF THE DRAWINGS

FIG. 1A shows the photoreceptor voltage profile after uniform charging.

FIG. 1B shows the photoreceptor voltage profile after an exposure step.

FIG. 1C shows the photoreceptor voltage profile after a development step subsequent to the exposure step of FIG. 1B.

FIG. 1D shows the state of a toner image subsequent to the image being subjected to mechanical pressure in accordance with the present invention.

FIG. 1E shows the photoreceptor voltage profile and mechanically compressed toner image after a first recharging step.

FIG. 1F shows the photoreceptor voltage profile and mechanically compressed toner image after a second recharging step.

FIG. 1G shows the photoreceptor voltage profile after a subsequent exposure step.

DETAILED DESCRIPTION OF THE PREFERRED EMBODIMENT(S) OF THE INVENTION

This invention relates to an imaging system which is used to produce an Image On Image (IOI) color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass IOI color process system, and a single or multiple pass highlight color system.

Figure 2:
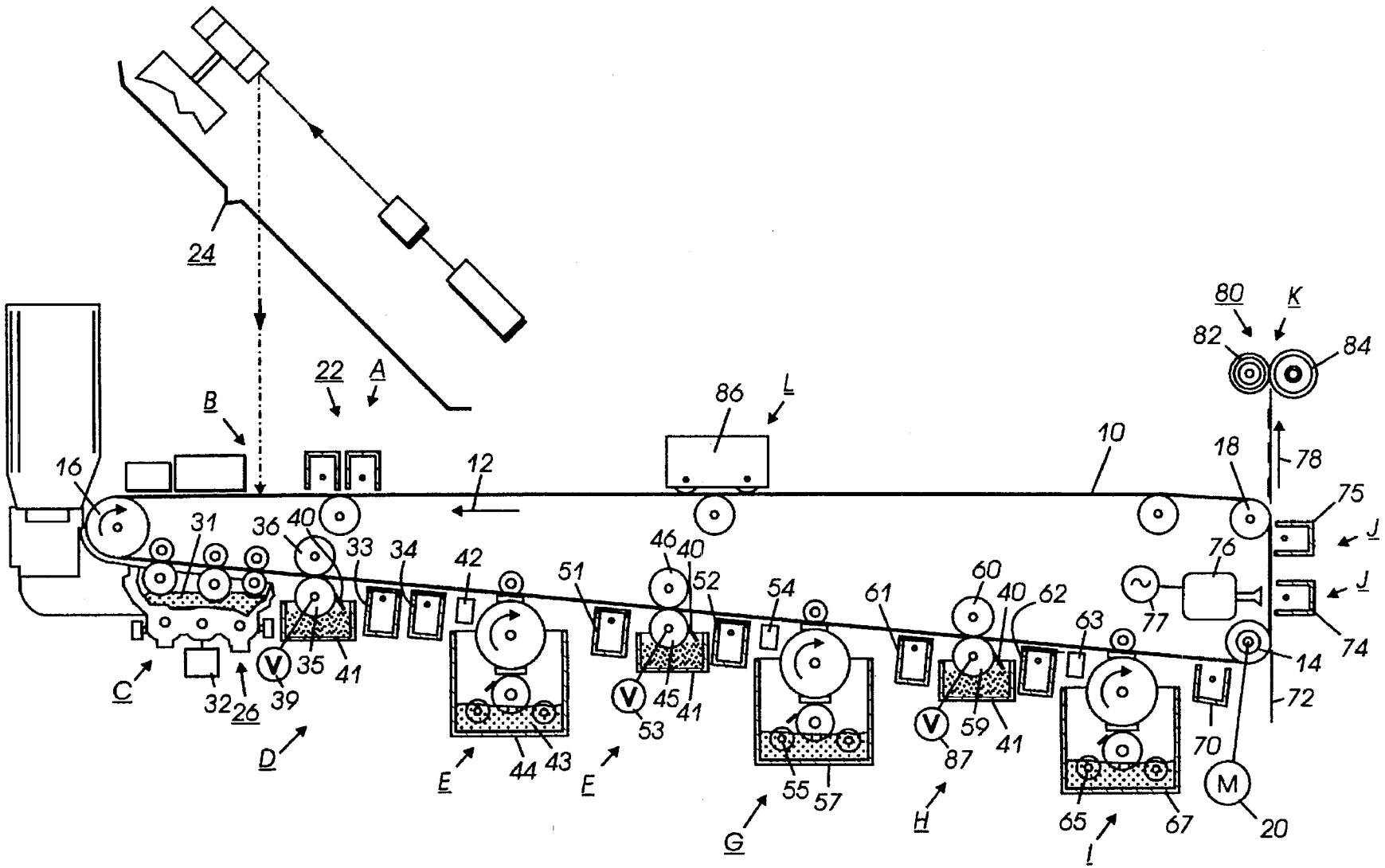
FIG. 2 is a schematic illustration of an single pass imaging apparatus incorporating the invention.

Turning now to FIG. 2, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18. The drive roller 14 is operatively connected to a drive motor 20 for effecting movement of the belt through the xerographic stations.

With continued reference to FIG. 2, a portion of belt 10 passes through charging station A where a corona generating arrangement, indicated generally by the reference numeral 22, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of photoconductive surface is advanced through an imaging or exposure station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices known in the art.

The photoreceptor, which is initially charged to a voltage $V_o$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a unipolar, negative voltage profile of high and low voltages, the former corresponding to charged areas and the latter corresponding to discharged areas. In the instant case, the discharged areas are the image areas while the charged areas represent the background voltage. It will be appreciated, that the charged areas may be used as the image areas in which case the discharged areas would represent the background.

At a first development station C, a magnetic brush developer housing structure, indicated generally by the reference numeral 26 advances Insulative Magnetic Brush (IMB) material or powder particles in the form of toner particles 31 into contact with the DAD image areas. The development structure 26 comprises a plurality of magnetic brush roller members. These magnetic brush rollers present, for example, negatively charged black toner material to the charged image areas for development thereof. Appropriate developer biasing is accomplished via power supply 32. Electrical biasing is such as to effect Discharged Area Development (DAD) of the less negative of the two voltage levels on the photoreceptor with the material 31.

At recharging station D, a pair of corona recharge devices 33 and 34 are employed for adjusting the voltage level of both the toned and untoned areas on the photoreceptor surface to a substantially uniform level. A power supply coupled to each of the electrodes of corona recharge devices 33 and 34 and to any voltage control element such as a scorotron grid associated therewith, serves as a voltage source to the devices. The recharging devices 33 and 34 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 33 overcharges the photoreceptor surface 10 containing previously toned and untoned areas, to a level higher than the voltage level $V_{ddp}$, for example, to −700 volts. The predominant corona charge delivered from corona recharge device 33 is negative. The second corona recharge device 34 reduces the photoreceptor surface 10 voltage to a desired final voltage, $V_f$, −500 volts. Hence, the predominant corona charge delivered from the second corona recharge device 34 is positive. Thus, a voltage split of 200 volts is applied to the photoreceptor surface. The voltage split ($V_{split}$) is defined as the difference in photoreceptor surface potential after being recharged by the first corona recharge device and the second corona recharge device, e.g. $V_{split}$=−700 volts —500 volts= −200 volts. The potential of surface 10 after passing the two corona recharge devices 33,34, as well as the amount of voltage split of the photoreceptor, are preselected to otherwise prevent the electrical charge associated with the developed image from substantially reversing in polarity, so that the occurrence of UCS is minimized. Further, the corona recharge device types and the voltage split are selected to ensure that the charge at the top of the toner layer is substantially neutralized rather than driven to the reverse polarity (e.g. from negative to become substantially positive). These parameters are described hereinbelow in further detail with reference to FIGS. 1A–1G.

A pair of pressure engaged rollers, 35 and 36 positioned after developer housing 26 serve to compact or compress toner images developed on the photoreceptor 10. As shown, the roller 35 is disposed outside of the loop of the belt 10 for contact with the powder images while the pressure roller 36 is disposed within the loop formed by the belt. Pressure engagement of the rollers 35,36 is effected using conventional camming structure (not shown). In operation the pressure rollers compress or compact the toner images on the belt 10. Image compression or compaction is effected after image development by developer housing 26 and prior to recharging with corona devices 33,34. The inner roller 36 comprises a soft nip-forming material for producing a uniform nip pressure along the nip. The outer pressure roller 35 comprises a hard roll with a low surface energy, semiconductive outer layer similar to the detoning roller in the cleaner of the Xerox™ 5090™ machine. The roller 35 is electrically biased via a power source 39. Electrical biasing of the semiconductive surface of the roller 35 is provided for effecting removal of wrong sign toner from the charge retentive surface 10 and preventing offset of toner particles forming the toner images. A cleaning blade 40 fabricated from steel is provided for removing developer material from the roller 35. The developer material so removed falls into a receptacle 41. The purpose of compressing or compacting the toner images using the rollers 35 and 36 is to further minimize the UCS phenomena so that together with the recharging of the images UCS may be avoided altogether.

A second exposure or imaging device 42 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas which are to be developed using discharged area development. To this end, a negatively charged developer material 43 comprising, for example, yellow color toner is employed. The toner is contained in a developer housing structure 44 disposed at a second developer station E and is presented to the latent images on the photoreceptor by a non-interactive, scavengeless developer system. A power supply (not shown) serves to electrically bias the developer structure to a level effective to develop the DAD image areas with the negatively charged yellow toner particles 43.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. The recharging devices 51 and 52 function in the same manner and for the same purpose as the corona devices 33 and 34.

A pair of pressure engaged rollers 45 and 46 disposed between the recharge devices 51 and 52 serve the same purpose and function as the pressure engaged rollers 35 and 36. A power supply 53 is provided for applying a suitable electrical bias to the roller 45. A cleaning blade 40 is provided for developer removal from the roller 45.

A third latent image is created using an imaging or exposure member 54. In this instance, a third DAD image is formed, discharging to approximately −50 volts those bare areas and toned areas of the photoreceptor that will be developed with the third color image. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging devices 61 and 62 are identical in function and purpose to the previously discussed recharging combinations 35,36 and 45,46.

A pair of pressure engaged roller 59 and 60 and associated components are provided intermediate the recharge devices 51 and 52 and serve the same purpose and function as previously discussed pressure engaged roller pairs 35,36 and 45,46.

A fourth latent image is created using an imaging or exposure member 63. A fourth DAD image is formed on both bare areas and previously toned areas of the photoreceptor that are to be developed with the fourth color image. This image is developed, for example, using a cyan color toner 65 contained in developer housing 67 at a fourth developer station I. Suitable electrical biasing of the housing 67 is provided by a power supply, not shown.

The developer housing structures 44, 57, and 67 are preferably of the type known in the art which do not interact, or are only marginally interactive with previously developed images. A non-interactive, scavengeless development device having minimal interactive effects between previously deposited toner and subsequently presented toner is described in U.S. Pat. No. 5,504,563 granted Apr. 2, 1996 to Dan A. Hays the relevant portions of which are hereby incorporated by reference herein.

In order to condition the toner for effective transfer to a final substrate, a negative pre-transfer corona device 70 delivers negative corona to ensure that all toner particles are of the required negative polarity to ensure proper subsequent transfer.

Subsequent to image development a sheet of support material 72 is moved into contact with the toner images at transfer station J. The sheet of support material is advanced to transfer station J by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer corona device 74 which sprays positive ions onto the backside of sheet 72. This attracts the negatively charged toner powder images from the belt 10 to sheet 72. A detack corona device 75 is provided for facilitating stripping of the sheets from the belt 10.

Also, at the transfer station J there is provided a relatively high frequency acoustic or ultrasonic resonator 76, driven by an AC power source 77, which is arranged in vibratory relationship with the backside of the belt 10 at a position corresponding to the location of the transfer corotron device 74. The resonator provides mechanical means for assisting with the transfer of toner to the copy sheet or substrate 72.

After transfer, the sheet continues to move, in the direction of arrow 78, onto a conveyor (not shown) which advances the sheet to fusing station K. Fusing station K includes a fuser assembly, indicated generally by the reference numeral 80, which permanently affixes the transferred powder image to sheet 72. Preferably, fuser assembly 80 comprises a heated fuser roller 82 and a backup or pressure roller 84. Sheet 72 passes between fuser roller 82 and backup roller 84 with the toner powder image contacting fuser roller 82. In this manner, the toner powder images are permanently affixed to sheet 72 after it is allowed to cool. After fusing, a chute, not shown, guides the advancing sheets 72 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L using a cleaning brush structure contained in a housing 86.

The various machine functions described hereinabove are generally managed and regulated by a controller (not shown), preferably in the form of a programmable microprocessor. The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The recharge devices 33, 34, 51, 52, 61 and 62 have been described generally as corona generating devices, with reference to FIG. 2. However, it is understood that the corona generating devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

In a preferred embodiment of the present invention and as further described with reference to FIGS. 1A–1G, a negative, high slope, voltage sensitive DC device is used for the first corona recharge device, and a high slope, voltage sensitive AC device is used for the second corona recharge device. These corona devices together with the pressure engaged rollers in the configurations illustrated accomplish the objectives of achieving voltage uniformity between previously toned areas and untoned areas of the photoreceptor so that subsequent exposure and development steps are effected across a uniformly charged surface; as well as reducing the residual charge of the previously developed areas so that subsequent development steps are effected across a uniform development field. Further, these objectives are successfully attained while ensuring that toner charge at the top of the toner layer is substantially neutralized rather than driven to reverse its polarity, so that UCS occurrence is avoided.

Figure 3:
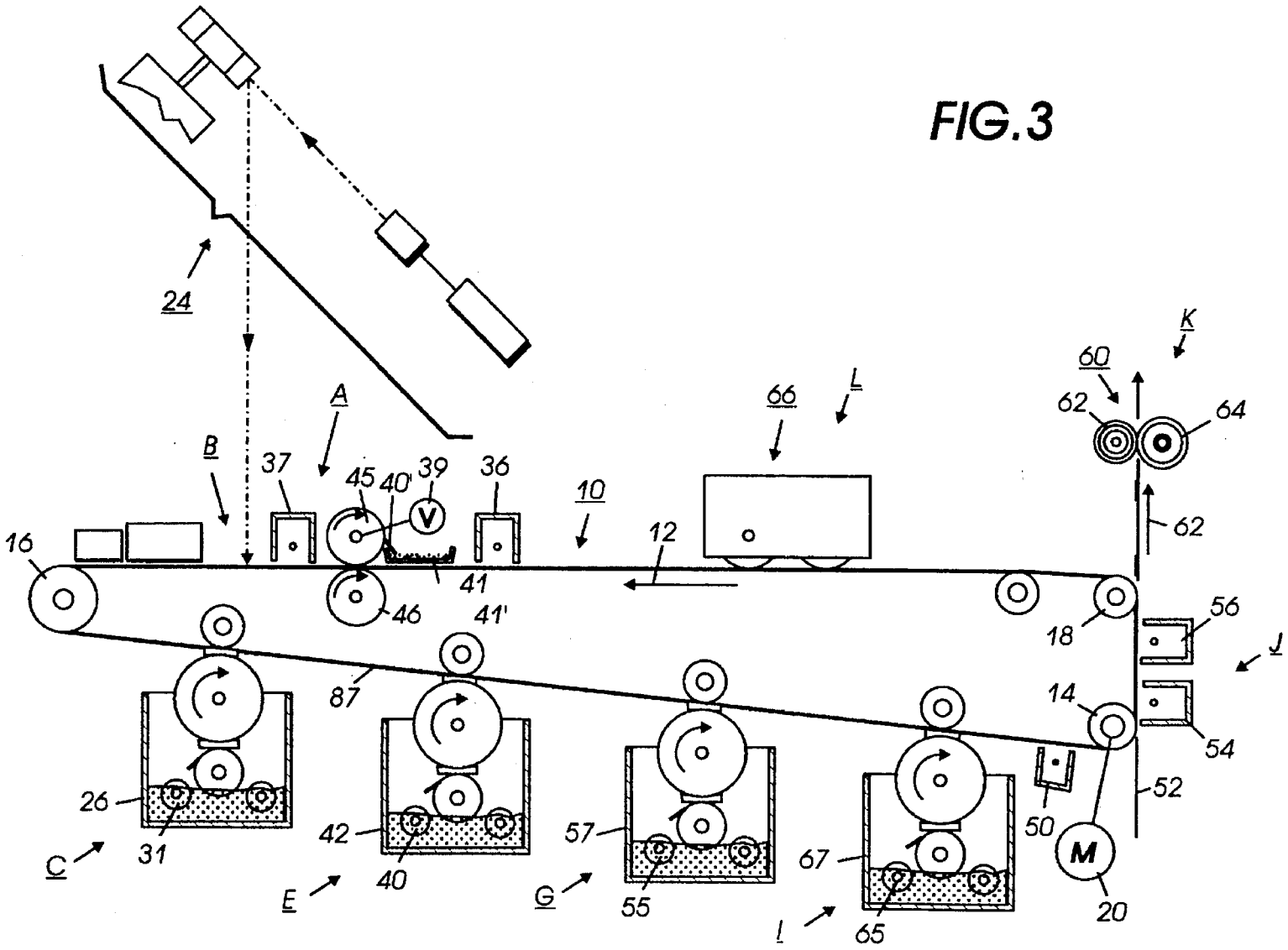
FIG. 3 is a schematic illustration of a multiple pass imaging apparatus incorporating the invention.

FIG. 3 illustrates another example of an electrostatographic printing apparatus which would find advantageous use of the present invention. FIG. 3 represents a multiple pass color image formation process, where each successive color image is applied in a subsequent pass or rotation of the photoreceptor. Like reference numerals to those in FIG. 2 correspond with identical elements to those represented in FIG. 2, with the exception that a non-interactive development system 88 containing developer material 31 and positioned at Development Station C replaces the magnetic brush development system used as an example in FIG. 2, for purposes of illustration of alternate embodiment of a reproduction apparatus in which the present invention may be utilized. Furthermore, in a multi-pass system as represented in FIG. 3, only a single set of recharging devices 36 and 37, indicated generally at charging/recharging station A, is needed to recharge the photoreceptor surface 10 prior to each subsequent color image formation. For purposes of simplicity, both recharging devices 36 and 37 can be employed for initially charging the photoreceptor using the split recharge concept of the present invention as hereinbefore described, prior to the exposure of the first color toner latent image. However, it is understood that a controller (not shown) could be used to regulate the charging step so that only a single recharge device is used to charge the photoreceptor surface to the desired voltage level for exposure and development thereon. Corona recharge device 33 is shown in FIG. 2 without a grid associated therewith, and corona recharge device 34 is shown with a grid, for purposes of illustration of different embodiments of the present invention. Also, only a single exposure device 24 is needed to expose the photoreceptor prior to each color image development. In a multipass system as illustrated in FIG. 3, it is understood that the cleaning station L is of the type that is capable of camming away from the surface of the photoreceptor during the image formation process, so that the image is not disturbed prior to image transfer.

Pressure engaged rollers 45 and 46 are provided in this muti-pass apparatus and are positioned intermediate the two recharging members for assisting in the prevention of UCS in the process of creating multiple images. A receptacle 41' is provided for collecting wrong sign toner removed from the roller 45 by a blade 40.

The voltage profiles on the photoreceptor 10 depicting a single split recharge step of the present invention during the image forming process described with reference to FIGS. 2 and 3, are illustrated in FIGS. 1A through 1G. FIG. 1A illustrates the voltage profile 90 on photoreceptor belt 10 after the belt surface has been uniformly charged. The photoreceptor is initially charged to a voltage slightly higher than the −500 volts but after dark decay the $V_{ddp}$ voltage level is −500 volts. After a first exposure, the voltage profile comprises high and low voltage levels 92 and 94, respectively. The level 92 at the original −500 volts represents the background area for the first image development step, and the level 94 at −50 volts (FIG. 1B) represents the area discharged by the laser 24 and corresponds to the image area to be developed by a single color toner.

During the first development step, the colored toner adheres to the DAD image area and causes the potential in the image area to be increased to approximately −200 volts, as represented by the solid line in FIG. 1C. The toner particles 73 have a negative charge associated therewith.

The development step using developer housing 26 is followed by a toner image conditioning step using pressure engaged rollers 45,46 for compressing the toned image as illustrated in FIG. 1D.

Following the aforementioned toner image compaction, the toned and untoned areas of the photoreceptor are subjected to the recharging step (FIG. 1E) using a preferred embodiment of the split recharge process previously described, the first corona recharge device 33 overcharges the toned areas 96 and background areas 92 of the photoreceptor to a negatively higher level than the ultimately desired second color $V_{ddp}$. Thus, after passing the first corona recharge device, the photoreceptor surface having the developed image thereon is charged to approximately −700 volts and the compacted toner particles 96 still have a negative charge associated therewith. Preferably, the second AC corona recharge device then delivers a predominately positive current to the photoreceptor surface to lower the photoreceptor potential to a uniform level of approximately $V_{ddp}$ of −500 volts (FIG. 1F) and substantially neutralize the charge of the toner particles 96 in the image area. Thus, the voltage split of the photoreceptor surface after being recharged by the first and second corona recharge devices is 200 volts.

The second charging device, preferably a high slope, voltage sensitive AC scorotron, will deliver current until the voltage of the photoreceptor is equal to the voltage of the grid (minus the offset associated with the scorotron). With use of a voltage sensitive AC scorotron, the voltage at the top of the toner layers and bare photoreceptor reach the grid voltage at a fast rate, and therefore voltage uniformity between the toned areas and untoned areas of the photoreceptor is achieved. Since the AC device delivers both positive and negative ions, it will substantially neutralize the toner charge rather than change it to an opposite polarity (positive). Another factor contributing to the outcome of substantial neutralization of the toner charge is the relatively small $V_{split}$ level applied to the photoreceptor surface between the first and second corona recharge devices. Therefore, in the preferred configuration of a high slope, direct current corona generating device for the first recharge step, used in conjunction with a high slope, voltage sensitive alternating current corona generating device for the second recharge step, whereby a relatively low voltage split of the photoreceptor is applied therebetween, voltage uniformity is achieved between toned and bare areas of the photoreceptor, and the charge at the top of the toner layer is substantially neutralized, FIG. 1F.

Furthermore, inside a negative toner layer, the high electric fields present typically prevent positive corona ions from getting into the layer. However, by using a high slope, voltage sensitive AC corona generating device as the second of the corona recharge devices of the present invention, more positive charges emanating from the device are able to attach themselves to the top surface of a toner layer, causing the average charge to sit closer to the photoreceptor. The residual voltage $V_r$ of the toner layer is thereby substantially reduced or eliminated, as $V_r$ is directly proportional to the integrated sum of the distances of the negative charges of the toner layer from the photoreceptor surface. A voltage sensitive corona recharge device whose graph of the output current (I) to the photoreceptor surface as a function of the voltage to the photoreceptor surface (V) has a high characteristic (I/V) slope, used for recharging a photoreceptor having a toner image developed thereon, is described in concurrently filed application for U.S. Patent titled "Method and Apparatus for Reduced Residual Toner Voltage", (D/92483), having a common assignee as the present application, the relevant portions of which are hereby incorporated by reference herein.

After this split recharge step (FIG. 1F), the photoreceptor is uniformly charged, the residual toner present on the previously developed toner layer is substantially reduced, and the toner charge at the top of the toner layer is substantially neutralized. The photoreceptor is again ready for forming another DAD image 98 thereon by exposing those bare areas 92 and image areas 96 (FIG. 1G).

While the foregoing description was directed to a $DAD_n$ image on image process color printer where a full color image is built in a single pass of the charge retentive surface, it will be appreciated that the invention may also be used in a charged area development $CAD_n$ or $CAD–DAD_n$ in both single pass or multiple pass systems, as well as in a single or multiple pass highlight color process machine.

What is claimed is:

1. A method of creating multiple powder images, said method including the steps of:

using powder marking particles, forming a first powder image on a charge retentive surface;

conditioning said first powder image for minimizing the disturbance thereof as it passes through a development housing, said step of conditioning comprising compacting of powder marking particles forming said first powder image; and forming a second powder image.

2. A method according to claim 1 wherein said step of compacting comprises using a mechanical device.

3. A method according to claim 2 wherein said mechanical device comprises a pair of pressure engaged rollers.

4. A method according to claim 3 wherein said step of treating includes using corona emissions.

5. A method according to claim 4 wherein said step of conditioning includes using corona emissions before and after said step of compacting for minimizing voltage differences between image and non-image areas on said charge retentive surface.

6. A method according to claim 5 including the step of electrically biasing one of said pressure engaged rollers for attracting wrong sign toner from said charge retentive surface.

7. A method according to claim 5 wherein said one of said pressure engaged rollers is biased such that it minimizes the offset of powder particles from said images.

8. A method according to claim 7 including the step of removing powder particles from said one of said pressure engaged rollers.

9. A method according to claim 8 wherein said one of said pressure engaged rollers contacts said powder images and another one of said pressure engaged rollers contacts the back of said charge retentive surface.

10. A method according to claim 4 wherein said step of using corona emissions serves to minimize the difference in electrical between imaged and non-imaged areas of said charge retentive surface.

11. Apparatus for creating multiple powder images, said apparatus comprising:

means for forming a first powder image on a charge retentive surface;

means for conditioning said first powder image for minimizing the disturbance thereof as it passes through a development housing, said conditioning means comprising means for compacting powder marking particles forming said first powder image; and means forming a second powder image.

12. Apparatus according to claim 11 wherein said means for compacting comprises a mechanical device.

13. Apparatus according to claim 12 wherein said mechanical device comprises a pair of pressure-engaged rollers.

14. Apparatus according to claim 13 wherein said means for treating includes corona emissions structure.

15. Apparatus according to claim 14 wherein said means for conditioning includes means for generating corona emissions before and after said means for compacting for minimizing voltage differences between image and non-image areas on said charge retentive surface.

16. Apparatus according to claim 15 including means for electrically biasing one of said pressure engaged rollers for attracting wrong sign toner from said charge retentive surface.

17. Apparatus according to claim 15 wherein said one of said pressure engaged rollers is biased such that it minimizes the offset of powder particles from said images.

18. Apparatus according to claim 17 including means for removing powder particles from said one of said pressure engaged rollers.

19. Apparatus according to claim 18 wherein said one of said pressure engaged rollers contacts said powder images and another one of said pressure engaged rollers contacts the back of said charge retentive surface.

20. Apparatus according to claim 14 wherein said corona emissions structure serves to minimize the difference in electrical between imaged and non-imaged areas of said charge retentive surface.

* * * * *